US006401421B1

(12) United States Patent
Zeman

(10) Patent No.: US 6,401,421 B1
(45) Date of Patent: Jun. 11, 2002

(54) CONSTRUCTION ELEMENT

(75) Inventor: Miroslav Zeman, Sidl. Osvobozeni 15/628, 68201 Vyškov (CZ)

(73) Assignee: Miroslav Zeman, Vysok (CZ)

( * ) Notice: Subject to any disclaimer, the term of this patent is extended or adjusted under 35 U.S.C. 154(b) by 0 days.

(21) Appl. No.: 09/555,142

(22) PCT Filed: Nov. 26, 1998

(86) PCT No.: PCT/CZ98/00044

§ 371 (c)(1),
(2), (4) Date: May 25, 2000

(87) PCT Pub. No.: WO99/28697

PCT Pub. Date: Jun. 10, 1999

(30) Foreign Application Priority Data

Nov. 26, 1997 (CZ) ..... 3733-97

(51) Int. Cl.[7] ..... F41H 11/08

(52) U.S. Cl. ..... 52/608; 52/611; 405/16; 405/19

(58) Field of Search ..... 52/608, 611, 695; 405/15–17, 33, 258, 262, 273, 284–286; 404/35–42

(56) References Cited

U.S. PATENT DOCUMENTS 2,374,624 A * 4/1945 Schwendt ..... 52/608 X
3,252,287 A * 5/1966 Suzuki ..... 52/611 X
3,759,043 A * 9/1973 Tokunaga ..... 52/609 X
4,083,190 A * 4/1978 Pey ..... 52/608 X
4,594,023 A * 6/1986 O'Neill ..... 52/608 X
4,990,032 A * 2/1991 Smith ..... 52/608 X
5,020,938 A * 6/1991 Scales ..... 52/608 X

* cited by examiner

*Primary Examiner*—Richard Chilcot
(74) *Attorney, Agent, or Firm*—Blank Rome Comisky & McCauley LLP

(57) ABSTRACT

For military as well as for civil applications there is provided a construction element comprising a disc-shaped central part (1) with at least four legs (2) extending outwards substantially radially with respect to a transversal axis (3) of the central part (1) and having longitudinal axes arranged in a plane perpendicular to the transversal axis (3) of the central part (1). The central part (1) has a face recess (4) extending inwardly from the central part (1) periphery between two adjacent legs (2). The face recess (4) has a width corresponding to the central part thickness and a depth being equal from one to two thirds of the central part width measured along an axis (8) of the face recess (4). The central part (1) is also furnished with a first passage (5) the axis (6) of which is parallel to the transversal axis (3) of the central part (1), and with a second passage (7), opening into the central part (1) face walls and having an axis (9) perpendicular to the axis (8) of the face recess (4). Each leg (7) includes a mounting duct (12) opening into both opposite front surfaces of the leg (7).

6 Claims, 1 Drawing Sheet

CONSTRUCTION ELEMENT

TECHNICAL FIELD

The invention relates to a construction element and more specifically to an element for a construction of support and/or carrier structures.

BACKGROUND OF THE INVENTION

Robustness of a defence build for army troops in a terrain depends upon barriers which should effectively protect soldiers in the defence and make movements of an enemy more difficult and even prevent them, or at least direct them towards a pre-selected area. Barrier systems comprise a complex of natural and man-made non-explosive and explosive devices. Nevertheless for a long time no attention had been paid to non-explosive barriers though at the beginning of a military conflict, at the moment of an attack, they are important for protection of boarders and preparation of military resistance posts at directions of assumed advance of the enemy. Due to international activities of their opponents, use of explosive barriers, especially mines of any type and application, have been significantly limited. Thus an importance of barriers of the non-explosive type has increased. Barriers of this type could be divided in three basic groups, each of them having own sub-groups. There exist anti-tank barriers, such as walls, steep slopes, ditches, undercut trees and iron-concrete pyramids, anti-transport barriers comprising damaging up to devastation of existing roads and ways, ditches, undercut trees, traps, obstacles like barricades and finally there are anti-infantry barriers, especially various wire systems, undercut trees, horns and hedgehogs made of wood or iron. As experienced from military conflicts throughout the world and from results of tests, which have been carried out in specialised laboratories or within military training, the arrangements known so far become less and less effective because of improving parameters of the present military equipment and techniques. As an example there could be presented concrete pyramids anchored in an earth, which are no obstacle for up-today tanks. And what is also very important, all the known technology of creation of barriers demands lot of machinery, manpower and is very costly as there are used devices and elements having no other application but the military one. On a site an extensive application of earthwork building machines, mechanical loaders, trucks, cars or railroad wagons, to say nothing about hand engineer equipment, is always necessary. It is an object of the invention to create a construction element for building of barriers with higher efficiency when compared with the present ones, the element being suitable also for structures of different types of application, namely for civil ones.

DISCLOSURE AND OBJECT OF THE INVENTION

The object of the invention is achieved and the foregoing problems are solved by a construction element in accordance with the present invention, the element comprising a disc-shaped central part with at least four legs extending outwards substantially radially with respect to a transversal axis of the central part and having longitudinal axes arranged in a plane perpendicular to the transversal axis of the central part, the central part having a face recess extending inwardly from the central part periphery between two adjacent legs, the face recess having a width corresponding to the central part thickness and the depth being equal from one to two thirds of the central part width measured along an axis of the face recess. The central part forming an integral unit with the legs and preferably made of concrete and/or ferro-concrete, may be provided with a metal jacket. Further according to the invention the central part comprise a first passage, the axis of which is parallel to the transversal axis of the central part, and further comprise a second passage, which is opening into the central part periphery walls and is perpendicular to the axis of the face recess. The distance between intersections of the axis and the face recess with the second passage axis and with the transversal axis of the central part equals the distance between intersections of the axis of the face recess with the second passage axis and with the transversal axis of the central part. Further improvement is achieved by furnishing each leg with skew surfaces, the first one of which being located within a plane perpendicular to the axis of the face recess and the other one within a plane perpendicular to the first skew surface. Still further in accordance with the present invention each leg may comprise a mounting passage, opening into both opposite side surfaces of the leg.

The construction element according the invention may be preferably applied as a separate unit or for assemblies, even assemblies having complicated forms, thus allowing for construction of all-purpose barriers meeting a wide variety of problems presented by particular terrain and climate conditions. The element provides high barrier resistance against military vehicles and other equipment, mobility even by low application of transport facilities, possibility of assembling only by manual power, little requirements upon storage room and long life-time of the construction accommodating the element(s). The element is suitable also for civil applications, such as walling of outside banks of river meanders to keep water streams within present banks, creation of barriers against flooding water, creation of barriers protecting bridge piers, construction of temporary bridges construction of temporary jetties on shores etc. Especially by sudden disasters like floods, when in a very short time it is necessary to reinforce damaged terrain or buildings in danger and thus prevent further damages the element should find an application.

BRIEF DESCRIPTION OF THE DRAWINGS

By way of an example the invention will now be described with reference to the accompanying drawings where.

DESCRIPTION OF A PREFERRED EMBODIMENT

Figure 1:
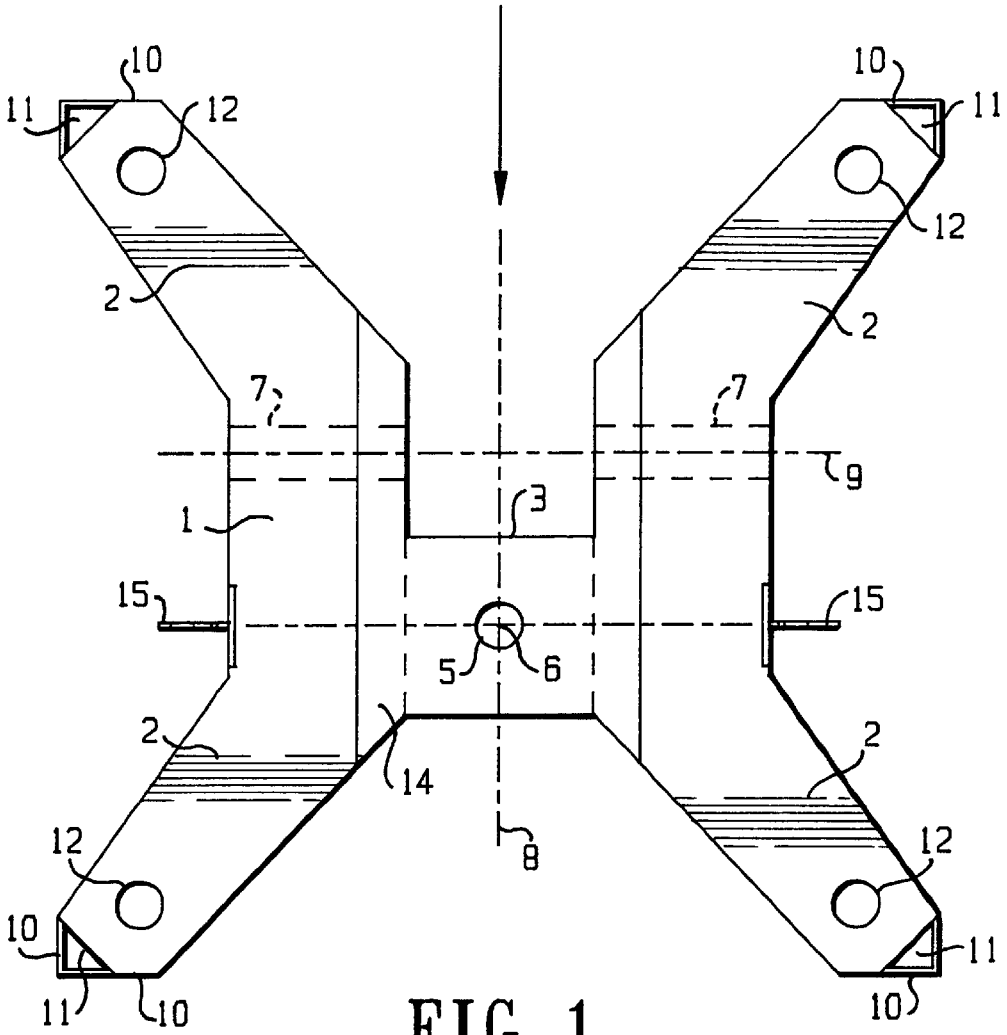
FIG. 1 presents a view upon the construction element having four legs and FIG. 2 shows the element according to FIG. 1 as faced along the direction P.
Figure 2:
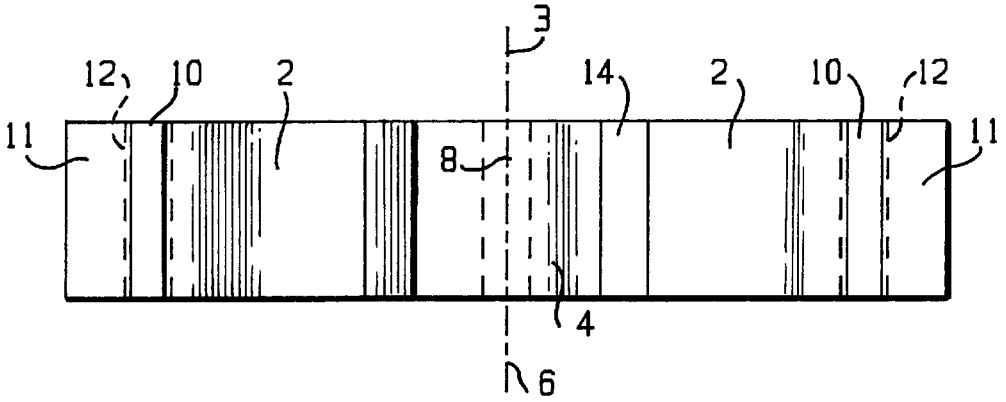

The construction element presented in the drawings comprise a disc-shaped central part 1 equipped with four legs 2. The legs 2 extend outwards substantially radially with respect to a transversal axis 3 of the central part 1 and have their longitudinal axes arranged in a plane perpendicular to the transversal axis of the central part 1. The central part 1 is further furnished with a face recess 4 extending inwardly from the central part 1 periphery between two adjacent legs 2. The face recess 4 has a width corresponding to the central part thickness and the depth being equal to a half of the width of the central part width, as measured along the axis 8 of the face recess 4. The depth of the face recess 4 may vary from one to two thirds of the width of the central part width. The central part 1 is further provided with two passages. The first passage 5 has an axis 6 which is parallel to the transversal axis 3 of the central part 1, while the second passage 7, opening into periphery, face walls of the central part 1, has an axis 9, which is perpendicular to the axis 8 of the face recess 4. For both passages 5, 7 it applies the distance between intersections of the axis 8 of the face recess 4 with the first passage axis 6 and with the transversal axis 3 of the central part 1 respectively equals the distance between intersections of the axis 8 of the face recess 4 with the second passage axis 9 and with the transversal axis 3 of the central part 1 respectively. Each of the four legs 2 ends with a chamfering. Thus each leg 2 has skew surfaces 10, the first one of which is located within a plane perpendicular to the axis 8 of the recess 4 and the other one within a plane perpendicular to the first skew surface 10. The leg chamfering is reinforced by a metal cover 11, preferably made of steel, the cover 11 being countersunk into the leg 2 body. Each leg 2 is provided with at least one mounting passage 12 opening into both opposite front surfaces of the leg 2. The axis of the mounting passage 12 is, but need not be, parallel with the transversal axis 3 of the central part 1, or perpendicular to the leg 2 front surface.

From the point of view of manufacture of the element the central part 1 and the legs 2 form an integral unit, the unit being made of concrete and/or ferro-concrete.

The recess 4 facilitates mounting of a basic set comprising two elements anchored into each other in a way that each element faces the one by its recess 4, their transversal axis 3 being mutually turned by 90° and the central part 1 with the first hole 5 of one element is partially inserted into the recess 4 of the other element. For easier mounting and to reduce mechanical wear at places of mutual contact of both elements the central part 1 of each element is within and/or around its recess 4 furnished with a metal jacket 14, preferably made of steel. The jacket 14 covers both front faces of the central part 1 within an area coaxial but wider than the recess 4, provided that inside walls of the recess 4 are completely covered by the jacket 14. Within side walls of the central part 1 the jacket 14 fits into surface of this wall. The overall width of the recess 4, incl. the jacket 14, shall be at least as wide as the thickness of the central part 1, also incl. the jacket 14. Nevertheless the recess width should allow for easy mounting of sets.

Apart from already described passages 5, 7, 12 the element comprise studs 15 located in the same face wall of the central part 1 which accommodate the second passages 7. The studs 15, preferably of steel facilitate mounting and binding of elements into sets.

The element may have also only three or even more than just four legs 3, as described above. Number of legs 2 depends upon particular application, for military purposes, for construction of barriers four legs offer an optimal solution. Particularly for barriers the above described basic set, comprising two mutually anchored elements should find its basic application. Such a set represents arrangement of elements into two mutually perpendicular planes, the arrangements showing good stability and resistance against front impact.

Industrial Applications

The present invention is designed for military applications, but offers very wide range of application in the field of civil engineering, especially for creation of temporary constructions.

What is claimed is:

1. A construction element for construction of support and/or carrier structures, comprising a disc-shaped central part with at least four legs extending outwards substantially radially with respect to a transversal axis of the central part and having longitudinal axes arranged in a plane perpendicular to the transversal axis of the central part, the central part having a face recess extending inwardly from the central part periphery between two adjacent legs, the face recess having a width corresponding to the central part thickness and a depth of from one to two thirds of the central part width measured along an axis of the face recess.

2. The construction element according to claim 1, wherein the central part and the legs form an integral unit made of concrete and/or ferro-concrete.

3. The construction element according to claim 2, wherein the central part is provided with a metal jacket to reduce mechanical wear.

4. A construction element according to claim 1, where the central part is furnished with a first passage, the axis of which is parallel to the transversal axis of the central part, the central part being further provided with a second passage which communicates with the central part face walls and has an axis perpendicular to the axis of the face recess, provided the distance between intersections of the axis of the face recess with the first passage axis and with the transversal axis of the central part equals the distance between intersections of the axis of the face recess with the second passage axis and with the transversal axis of the central part.

5. A construction element according to claim 1, wherein each leg is terminated with face skew surfaces, the first one of which being located within a plane perpendicular to the axis of the recess and the other one within a plane perpendicular to the first skew surface.

6. A construction element according to claim 1, wherein each leg comprises a mounting duct opening into both opposite front surfaces of the leg.

* * * * *